US009459061B2

(12) United States Patent
Cassels

(10) Patent No.: US 9,459,061 B2
(45) Date of Patent: Oct. 4, 2016

(54) SUPER AND SUBSONIC GAS REGULATOR ASSEMBLY

(71) Applicant: Charles B. Cassels, New Smyma Beach, FL (US)

(72) Inventor: Charles B. Cassels, New Smyma Beach, FL (US)

( * ) Notice: Subject to any disclaimer, the term of this patent is extended or adjusted under 35 U.S.C. 154(b) by 0 days.

(21) Appl. No.: 14/687,148

(22) Filed: Apr. 15, 2015

(65) Prior Publication Data

US 2015/0292825 A1 Oct. 15, 2015

Related U.S. Application Data

(60) Provisional application No. 61/979,584, filed on Apr. 15, 2014.

(51) Int. Cl.
*F41A 5/28* (2006.01)

(52) U.S. Cl.
CPC ..... *F41A 5/28* (2013.01)

(58) Field of Classification Search
CPC ..... F41A 5/28
USPC ..... 89/193
See application file for complete search history.

(56) References Cited

U.S. PATENT DOCUMENTS 7,461,581 B2 12/2008 Leitner-Wise
7,610,844 B2 * 11/2009 Kuczynko ..... F41A 5/28 89/193
7,739,939 B2 6/2010 Adams
7,856,917 B2 * 12/2010 Noveske ..... F41A 5/28 89/193
7,891,284 B1 * 2/2011 Barrett ..... F41A 5/28 89/14.4
7,934,447 B2 5/2011 Kuczynko et al.
8,161,864 B1 * 4/2012 Vuksanovich ..... F41A 5/26 89/191.01
8,210,089 B2 7/2012 Brown
8,316,756 B1 * 11/2012 Woodell ..... F41A 5/28 89/193
8,607,688 B2 * 12/2013 Cassels ..... F41A 5/28 89/191.01
8,701,543 B2 * 4/2014 Brinkmeyer ..... F41A 5/28 89/191.01
8,863,639 B2 * 10/2014 Gomez ..... F41A 5/18 89/191.01
8,875,614 B2 * 11/2014 Gomez ..... F41A 5/28 89/193
8,960,069 B1 * 2/2015 Soong ..... F41A 5/28 89/193

* cited by examiner

*Primary Examiner* — Troy Chambers
*Assistant Examiner* — Joshua Semick
(74) *Attorney, Agent, or Firm* — Carter, Deluca, Farrell & Schmidt

(57) ABSTRACT

A retro fit capable super & subsonic gas regulator assembly designed to interface with an auto-loading gas operated host firearm is provided to replace existing gas systems. The gas regulator assembly optimizes gas flow into the host firearm's operating system. The gas regulator has a spring actuated gas regulator and cross-pin including a flat that disengages with the gas regulator when the gas regulator is rotated to allow the gas flow to be set to one of a plurality of gas settings e.g., four. In embodiments, setting one is optimal for using supersonic ammunition with a silencer, setting two is optimal for using supersonic ammunition without a silencer, setting three is optimal for subsonic ammunition, and setting four turns the gas flow off optimizing sound reduction and providing for manual operation of the host firearm. The system works by precisely metering gas entering the operating system and not by exhausting excess gas into the atmosphere. The super & subsonic gas regulator assembly provides optimal performance with both subsonic and supersonic ammunition in a single firearm allowing the operator full advantage.

16 Claims, 6 Drawing Sheets

SUPER AND SUBSONIC GAS REGULATOR ASSEMBLY

CROSS-REFERENCE TO RELATED APPLICATION

This application claims the benefit of and priority to U.S. Provisional Application Ser. No. 61/979,584, filed Apr. 15, 2014 which is incorporated herein in its entirety by reference.

BACKGROUND

1. Technical Field

The present disclosure relates generally to self loading firearms and, more particularly, to a super and subsonic gas regulator for use with self-loading firearms 2. Description of the Related Art Adjustable gas regulators have been utilized on self loading firearms since the 1940's. Some early examples are the Soviet SVT and Belgium FAL. The first gas regulators were designed primarily to deal with inconsistent pressures associated with ammunition of that time. This pressure differential would cause excessive wear and/or malfunctions of a firearm's operating system. With the improvement in modern ammunition manufacturing, the necessity for a gas regulator was mitigated and more modern firearms like the AK47 and the M16 were designed without a gas regulating capability. Now with an ever increasing use of silencers, many current designs like the Barrett REC7, Sig Sauer 516 and the Ruger SR-556 have reintroduced gas regulating features into their designs to manage back pressure.

Back pressure is created by a silencer forcing discharge gas into the rifles operating system. The increase in the volume of discharge gas passing through the operating system of a firearm can result in increased rates of fire, fouling, felt recoil, accelerated wear of the firearms components and a plethora of operational related malfunctions. With the introduction and increasing popularity of subsonic ammunition, a further evolution of the gas regulator is needed to optimize a firearm's operational capability with subsonic and supersonic ammunition, with and without silencer use.

Prior gas regulated firearms like the Belgium FAL and Soviet SVD regulate gas by exhausting gas into the atmosphere making these firearms impractical for silencer use because the exhausted gas would make a report and often flash upon entering the oxygen rich atmosphere, nullifying the silencing and flash hiding effect of a silencer. More recent designs like the Barrett REC7, Sig Sauer 516 and Ruger SR-556 have incorporated a silencer setting into their design, but all lack subsonic ammunition capability. The operator can only achieve a firearm's full potential when subsonic and supersonic ammunition can be utilized in a single firearm.

Subsonic ammunition offers a reduction in sound, flash, and actual and felt recoil, increasing firearm controllability over that of supersonic ammunition. Supersonic ammunition offers higher velocity, flatter trajectory, greater range, and higher kinetic energy over subsonic ammunition. The problem with existing gas regulators is that existing gas regulators do not have the capacity to utilize both subsonic and supersonic ammunition, nor do they offer a retro fit gas regulator conversion kit that is subsonic and supersonic capable. Furthermore existing gas regulators lack 360 degrees of adjustment, making them susceptible to accidental disassembly while in use.

The presently disclosed gas regulator offers many advantages over the prior art. More specifically, the presently disclosed gas regulator provides four positions of adjustment or gas settings including reduced gas flow, normal gas flow, subsonic gas flow, and no gas flow settings. Each position of adjustment has a precisely sized gas port to optimize performance with subsonic and supersonic ammunition with or without a silencer. The gas regulator works by restricting the flow of gas from the host weapons barrel and not by venting excess gas into the atmosphere. The gas regulator is spring actuated and includes a plurality of position stops that are positively engaged by a flat defined on a cross-pin to selectively lock the gas regulator in any one of the four positions of adjustment or gas settings. The method of actuating the gas regulator and the size of the gas regulator facilitate rapid ambidextrous single handed manipulation under adverse conditions while wearing gloves. Furthermore, the presently disclosed gas regulator does not require the use of tools or manual release activation to rotate between gas settings. In addition, the gas regulator can rotate continuously 360 degrees without accidental disassembly, while in use; however the gas regulator may be quickly and easily disassembled for routine maintenance. Furthermore, the gas regulator can be easily retro fitted to existing gas operated firearms.

SUMMARY

A gas regulator for use with a gas operated firearm is disclosed which includes a gas block configured with two gas block bores one to receive a barrel of a firearm and a second to receive a piston and gas regulator. A gas port is defined within the first gas block bore and is positioned to communicate with a gas port aperture of a firearm. A piston is dimensioned to slip fit within the second gas block bore. A gas regulator is dimensioned to be rotatably received within the second gas block bore, in communication with the piston. The gas regulator defines a plurality of regulator gas ports and position stops that are in alignment with the respective gas ports and spaced about the periphery of the regulator. The gas regulator is rotatably positioned within the gas block such that the gas regulator is selectively rotatable to position any one of the regulator gas ports in communication with the gas port of the gas block bore.

In one embodiment, an adjustment knob is configured at the forward end of the gas regulator. The adjustment knob is fixed in relation to the gas regulator such that rotation of the adjustment knob effects corresponding rotation of the gas regulator.

In one embodiment, the gas regulator includes at least two position stops that engage with a flat surface of the cross-pin to releasably retain the gas regulator in one of the four positions of adjustment or gas settings. It is envisioned that the gas regulator can define two or more gas settings and thus may be configured to be retained in any of a plurality of fixed positions. The gas regulator includes at least two position stops and a gas block with support structure to receive a cross-pin that, defines a cross-pin flat dimensioned to engage a position stop to rotatably maintain the adjustment knob and the gas regulator in a rotatably fixed position with respect to the gas block.

In one embodiment, the gas regulator is movable from a first position wherein at least one of the plurality of position stops are engaged with the cross-pin flat to a second position wherein the position stop is disengaged from the cross-pin flat. In embodiments, further rotation of the gas regulator engages a second position stop with the cross-pin flat to secure the gas regulator in a second fixed position in relation to the gas block. The plurality of position stops may include four position stops. Each of the plurality of position stops may be spaced 90 degrees from an adjacent position stop about the periphery of the gas regulator. In addition, a compression spring can be positioned to urge the position stops into engagement with the cross-pin flat.

BRIEF DESCRIPTION OF THE DRAWINGS

Various embodiments of the presently disclosed super & subsonic gas regulator assembly are disclosed herein with reference to the drawings wherein.

DETAILED DESCRIPTION OF EMBODIMENTS

Figure 1:
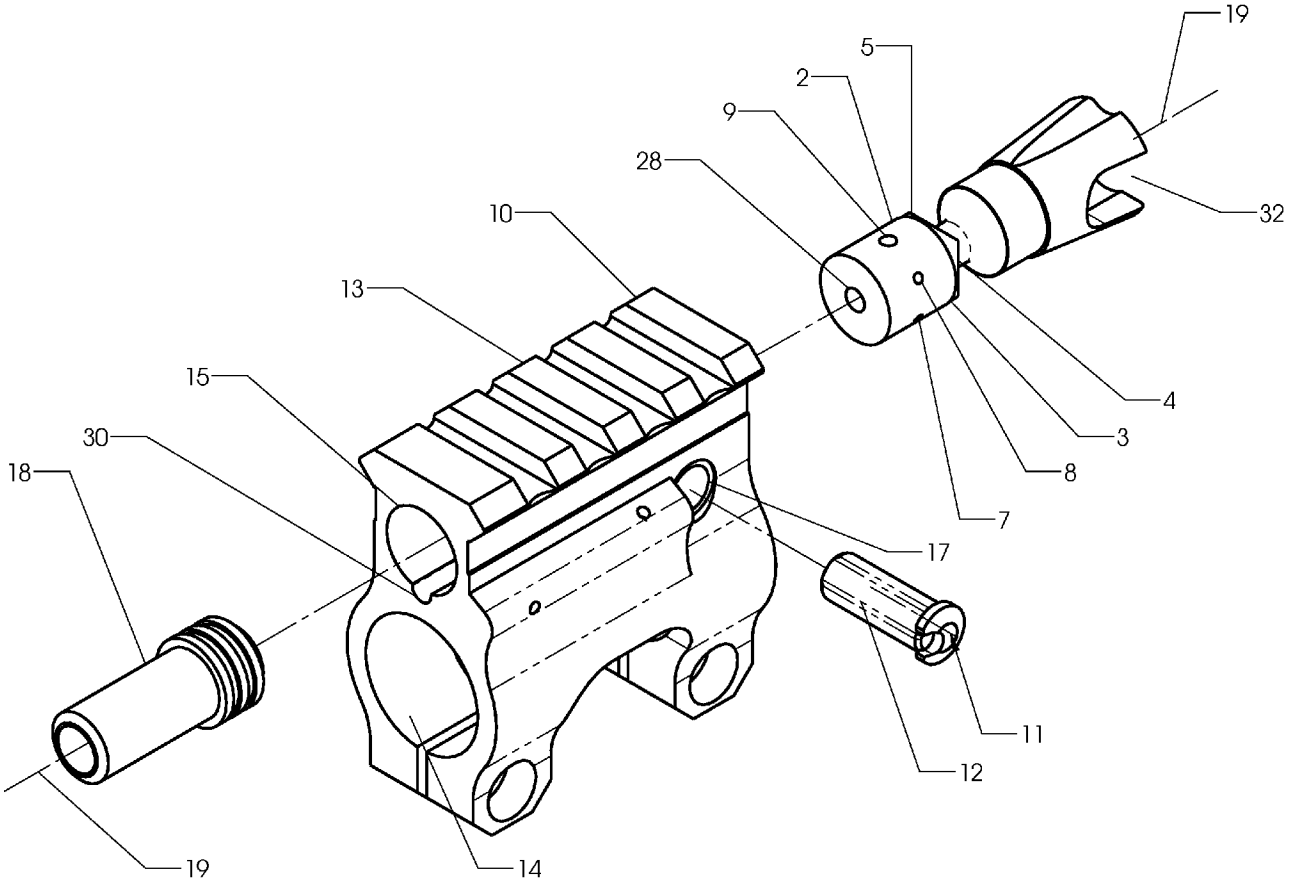
FIG. 1 is an exploded view in perspective of the presently disclosed super & subsonic gas regulator assembly including a Picatinny rail type gas block, removable gas regulator, cross-pin, and piston.

Embodiments of the presently disclosed super & subsonic gas regulator will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and/or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Figure 3:
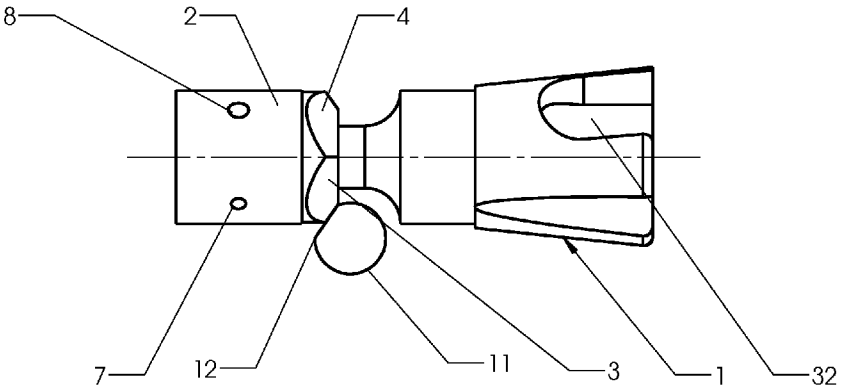
FIG. 3 is a perspective view of the position stop of the gas regulator in a disengaged position from the cross-pin flat of the super & subsonic gas regulator assembly shown in FIG. 2.
Figure 4:
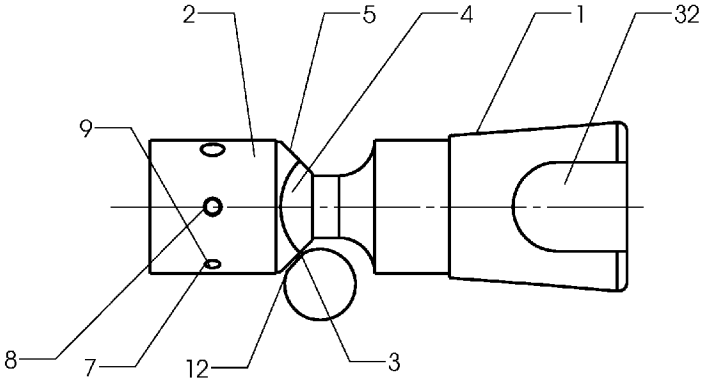
FIG. 4 is a perspective view of the position stop of the gas regulator fully engaged with the cross-pin flat of the super & subsonic gas regulator assembly shown in FIG. 3.
Figure 5:
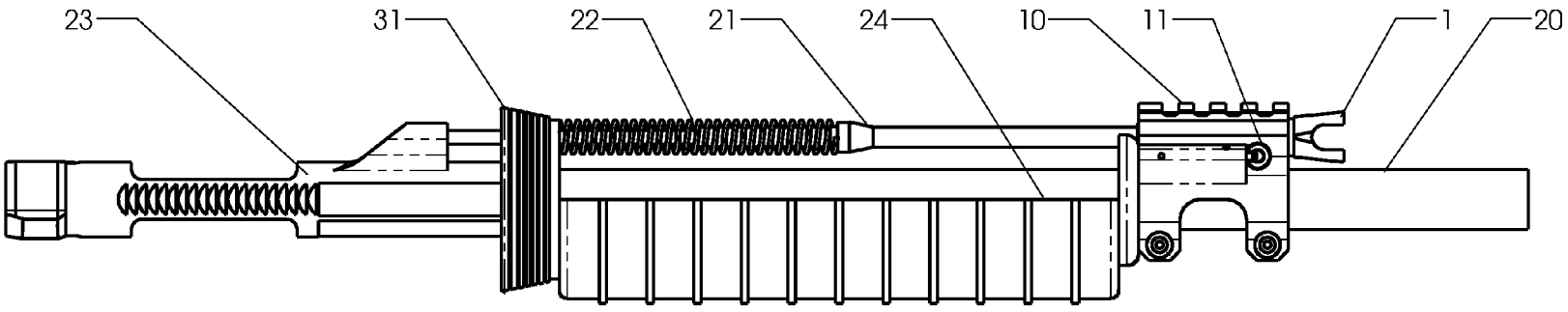
FIG. 5 is a side view of the super & subsonic gas regulator assembly as shown in FIG. 1 in an assembled state installed on a firearm.

Exemplary embodiments of the present disclosure are shown in FIGS. 1-7. Looking first at FIG. 1, super & subsonic gas regulator assembly 19 is shown in an exploded view, with dashed lines indicating the order and way of assembly. The primary parts of the super & subsonic gas regulator assembly 19 include a Picatinny-type gas block 10, a gas regulator 2, an adjustment knob 1, piston 18, and a cross-pin 11. The gas block 10 forms a rail mounting surface 13 on a top surface of gas block 10 for attaching accessories, e.g., sights, lasers, etc. Two longitudinal bores extend through the gas block 10 including a gas regulator bore 15 and a barrel bore 14. The gas regulator bore 15 is configured to receive the gas regulator 2, and piston 18. The barrel bore 14 is configured to receive a barrel of a firearm 20 as shown in FIG. 5. The gas regulator bore 15 is configured to slidably receive the piston 18 at one end, and to rotatably receive the gas regulator 2 at the other end. FIG. 5 illustrates the super & subsonic gas regulator assembly 19 as it would be assembled on a firearm with additional parts including an op-rod 21, a compression spring 22, barrel nut 31, and a bolt carrier 23. For a more detailed description of these components, see U.S. Pat. No. 8,607,688 which is incorporated herein in its entirety by reference.

Figure 6:
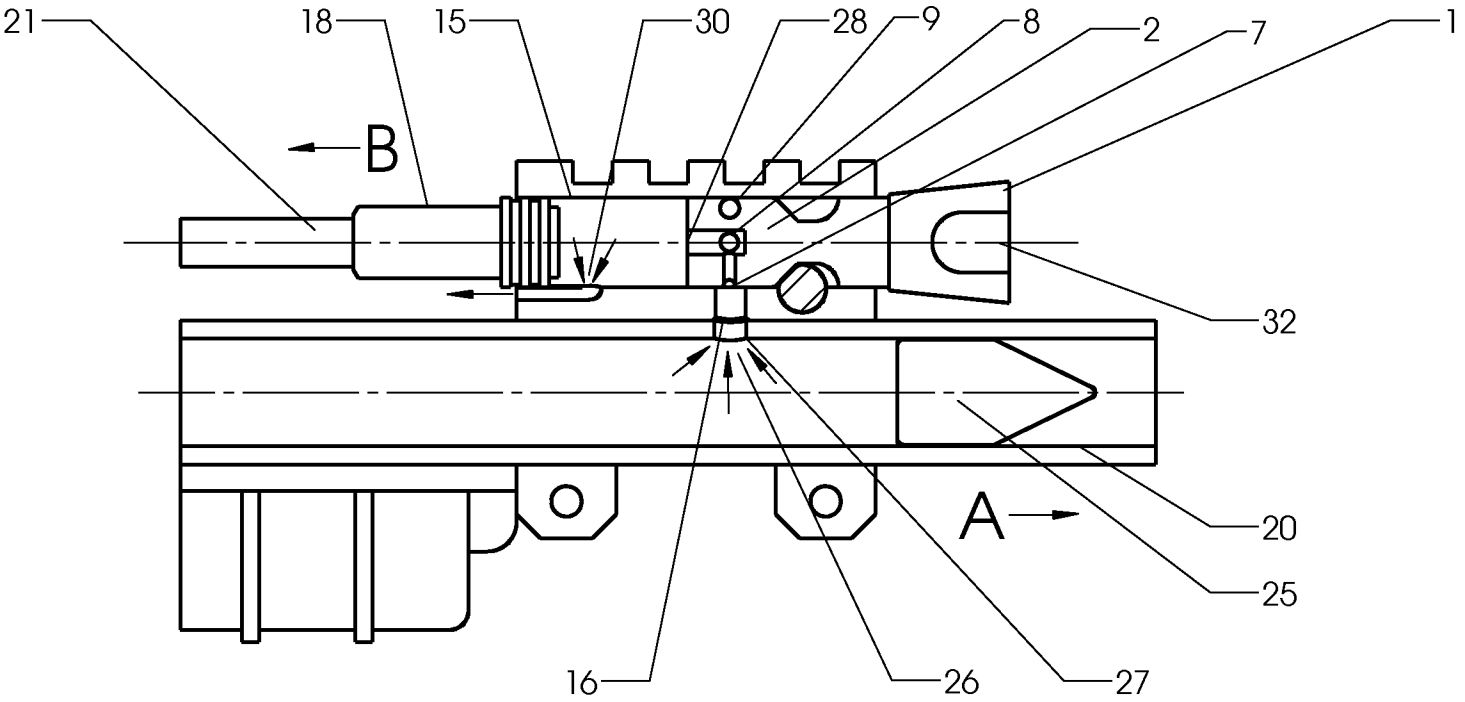
FIG. 6 is an enlarged side view of the fully assembled super & subsonic gas regulator assembly illustrating internal details of the gas regulator assembly and the gas flow path through the assembly as gas flows through the assembly.
Figure 7:
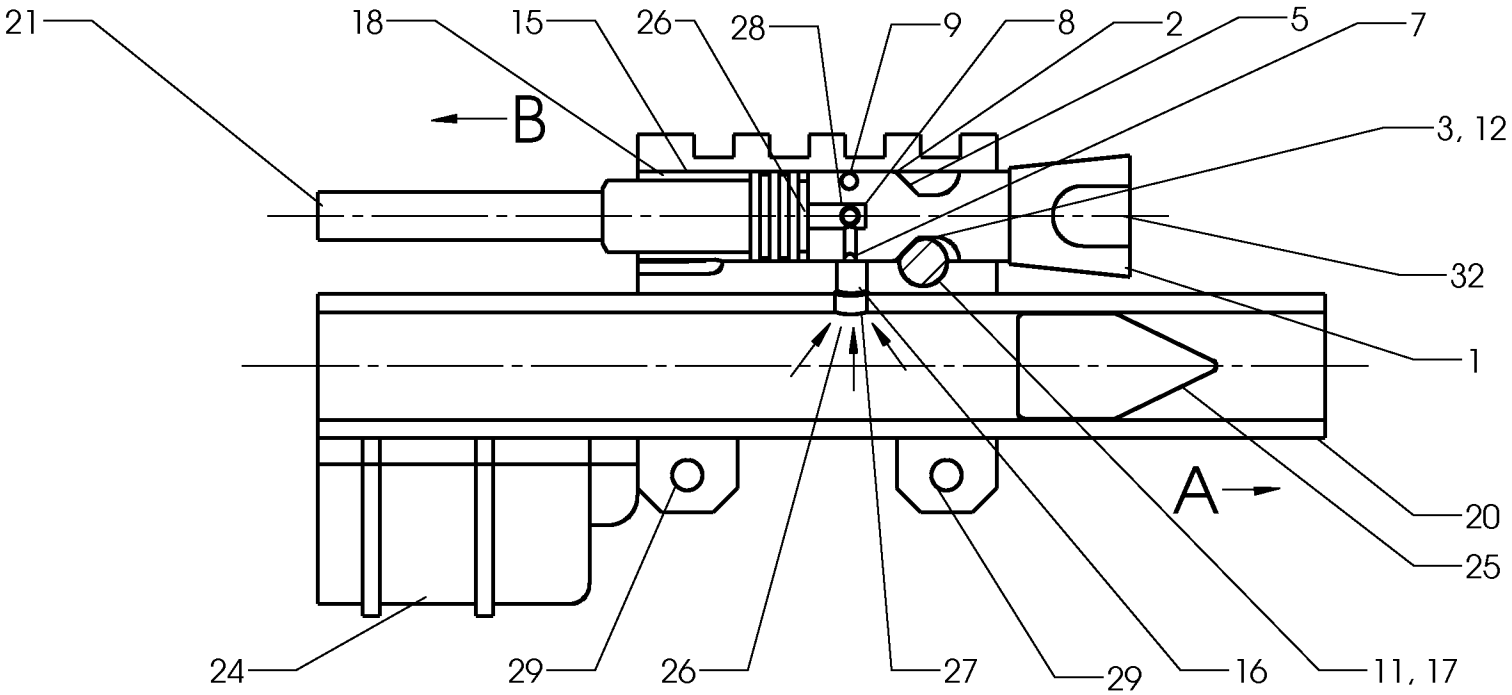
FIG. 7 is a close-up side view of the fully assembled super & subsonic gas regulator illustrating internal details of the gas regulating system upon receiving discharge gas from the barrel of a firearm.

Referring to FIGS. 1, 6 and 7, a barrel 20 of a firearm defines a gas port aperture 27 which communicates with a gas block gas port 16 formed through the gas block 10 and communicating with the gas regulator bore 15 of gas block 10. Gas block gas port 16 is positioned to communicate with any one of the gas regulator gas ports 7-9. As discussed above, gas block 10 includes barrel bore 14 which is dimensioned to receive barrel 20 of a rifle. Clamping screws 29 are provided to fixedly secure gas block 10 to barrel 20. The gas block 10 defines a cross-pin hole 17 which is aligned with position stops 3, 4, 5, or 6 formed in the gas regulator and positioned 90 degrees apart, about its periphery. In embodiments, the position stops are flat surfaces that are machined into the gas regulator 2. A cross-pin 11 is dimensioned to be received through cross-pin hole 17 in gas block 10 and defines a flat 12. The gas regulator 2 is rotatable within the gas regulator bore 15 to selectively move one of the position stops 3-6 into engagement with the flat 12 of the cross-pin 11 to secure gas regulator 2 in one of a plurality of axially and rotatably fixed positions within gas block 10. The gas regulator 2 is configured with three gas ports 7, 8, and 9 of various sizes spaced apart, e.g., 90 degrees, about its periphery. Alternately, the gas regulator can include two or more gas ports.

Figure 2:
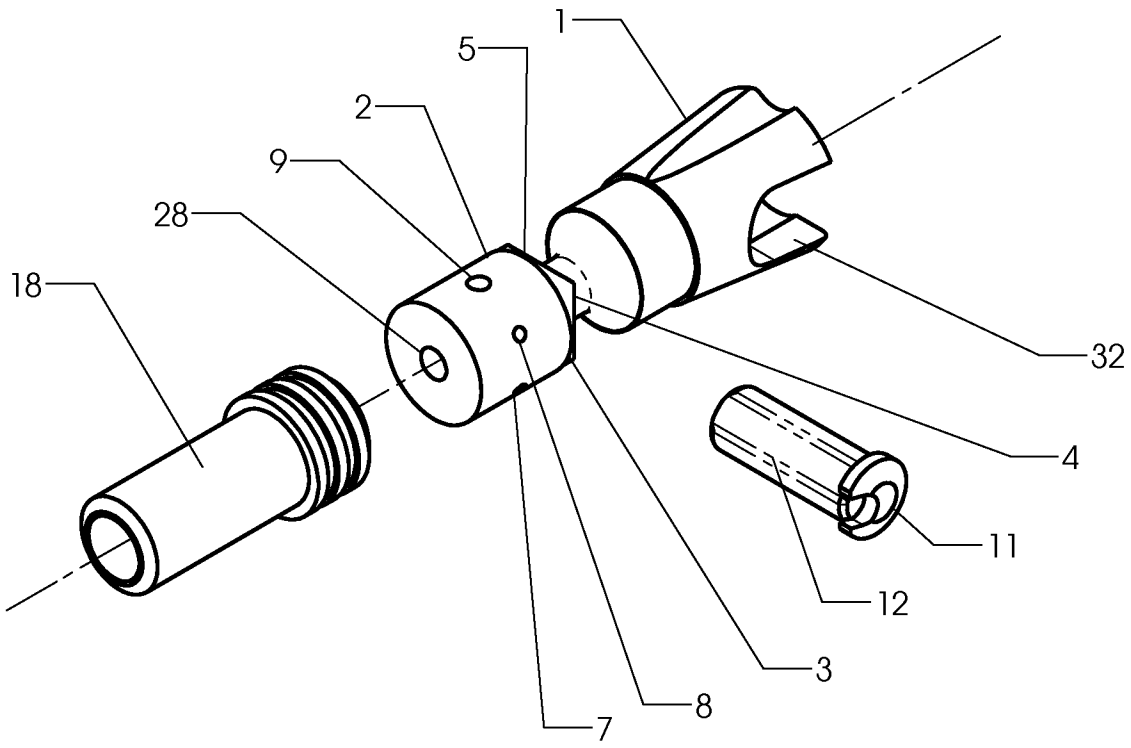
FIG. 2 is a perspective view with parts separated of the gas regulator, piston and cross-pin of the super & subsonic gas regulator assembly shown in FIG. 1.

Referring to FIGS. 2, 3, and 4, the gas regulator 2 is configured with an adjustment knob 1 at one end, position stops 3, 4, 5, and 6 at mid-shaft and regulator gas ports 7, 8, and 9 at the other end. Position stops 3-6 and regulator gas ports 7-9 are aligned with each other and positioned on the gas regulator 2 at 90 degree increments about its periphery. FIGS. 3 and 4 illustrate the interlocking relationship between position stops 3-6 and cross-pin flat 12. FIG. 3 shows the position stop 3 prior to full engagement with the cross-pin flat 12, and FIG. 4 shows the position stop 3 engaged with the cross-pin flat 12.

As illustrated in FIG. 5, gas regulator 2 maintains an interlocked relationship with cross-pin flat 12 under compressive force of compression spring 22 which is captured between the op-rod 21 and the barrel nut 31. As shown in FIG. 7, prior to gases entering the gas block bore 15, the piston 18 is engaged with the gas regulator 2 to urge a selected one of the position stops 3-6 into engagement with the cross-pin flat 12. The adjustment knob 1 is positioned forwardly of hand guard 24 and gas block 10 such that it is easily accessible to an operator. Because of the position of adjustment knob 1 and the type of interlocking engagement provided between position stops 3-6 and cross-pin flat 12, single handed manipulation or operation of adjustment knob 1 from either side of hand guard 24, is easily effected. More specifically, when an operator wants to change the gas setting, the operator turns the adjustment knob 1 to turn the gas regulator 2 within the gas regulator bore 15. As the gas regulator 2 is rotated, engagement between the cross-pin flat 12 and a respective position stop 3-6 will cam the gas regulator 2 axially against the bias of the spring 22, to allow the gas regulator 2 to move to a different gas setting. The spring 22 will return a selected one of the position stops 3-6 into engagement with the cross-pin flat 12 when the adjustment knob 1 is released to axially and rotatably fix the gas regulator 2 within the gas regulator bore 15.

Referring to FIG. 6, when a round is fired, a bullet 25 is propelled by discharge gases 26 located behind bullet 25 muzzleward, in the direction indicated by arrow "A". When the bullet 25 passes over the barrel gas port aperture 27 of barrel 20 of a firearm, a portion of the discharge gases 26 is directed through gas port aperture 27, through the gas block gas port 16, and into the gas regulator gas port 7. As the discharge gases 26 move through the gas regulator passage 28, the gases 26 exert a force that drives a piston 18, op-rod 21, and bolt carrier 23 in the direction indicated by arrow "B" to actuate the firearm's operating system. As piston 18 is driven rearwardly an exhaust port 30 is uncovered to allow the pressurized discharge gas 26 to be expelled from the gas regulator bore 15 to minimize excess gas and fouling, keeping fouling buildup to a minimum.

Referring to FIG. 7, gas flow into a firearm's operating system is traditionally set by the manufacturer and is determined by the size of the gas port aperture 27 created in the barrel 20 of the firearm. The super and subsonic gas regulator of the present disclosure regulates the amount of gases permitted to flow into the firearm's operating system by selectively positioning one of regulator gas ports 7-9 in communication with gas port aperture 27. More specifically, gas regulator 2 has adjustment knob 1 supported on the forward end of the gas block 10 such that rotation of adjustment knob 1 causes corresponding rotation of gas regulator 2. A position indicator 32 is selectively positionable, by rotating adjustment knob 1, to align/interlock any one of the position stops 3-6 with cross-pin flat 12 of the cross-pin 11. More specifically, when the adjustment knob 1 is positioned to locate a position indicator 32 at the shooters 3 o'clock position, the regulator gas port 7 is in communication with gas block gas port 16 of gas block 10 which communicates with gas port aperture 27 of barrel 20 of a firearm. In one embodiment, gas port 7 is dimensioned to restrict the flow of discharge gas 26 to an optimum level to run a silencer with supersonic ammunition. Further rotation of the adjustment knob 1 brings the position indicator 32 to the 6 o'clock position, to put regulator gas port 8 in communication with gas block gas port 16 of gas block 10 which communicates with gas port aperture 27 of barrel 20 of a firearm which allows an optimal flow of discharge gas 26 to cycle the host firearm without a silencer, using supersonic ammunition and under normal conditions. Further rotation of the adjustment knob 1 brings the position indicator 32 to the 9 o'clock position to align the regulator gas port 9 with the gas block gas port 16 of gas block 10 which communicates with gas port aperture 27 of barrel 20 of a firearm which allows an optimal flow of discharge gas 26 to cycle the host firearm with or without a silencer, using subsonic ammunition or using supersonic ammunition under adverse condition. Lastly, further rotation of adjustment knob 1 brings the position indicator 32 to the 12 o'clock position to move all of the regulator gas ports out of communication with gas block gas port 16 to shut off the flow of discharge gas 26 to the host firearm operation system, maximizing the silencing of the firearm by stopping the sound generated by the firearms action, and allowing the firearm to be manually operated. The super & subsonic gas regulator assembly is disclosed to have four distinct gas settings, it is envisioned that two or more gas settings may be provided, e.g., two, three or four.

Persons skilled in the art will understand that the devices and methods specifically described herein and illustrated in the accompanying drawings are non-limiting exemplary embodiments. It is envisioned that the elements and features illustrated or described in connection with one exemplarly embodiment may be combined with the elements and features of another without departing from the scope of the present disclosure. As well, one skilled in the art will appreciate further features and advantages of the system based on the above-described embodiments. Accordingly, the present disclosure is not to be limited by what has been particularly shown and described, except as indicated by the appended claims.

What is claimed is:

1. An adjustable gas regulator assembly for use with a gas operated firearm, the adjustable gas regulator assembly comprising:

a gas block defining a barrel bore configured to receive the barrel of a firearm, a cross-pin bore and a gas regulator bore, the gas regulator bore communicating with the barrel bore via a gas block gas port;

a gas regulator rotatably received within a first end of the gas regulator bore, the gas regulator defining a plurality of regulator gas ports, the gas regulator being rotatable within the first end of the gas regulator bore to selectively position any one of the plurality of regulator gas ports in registration with the gas block gas port;

a cross-pin positioned within the cross-pin bore, the cross-pin defining a first surface, wherein the gas regulator defines a plurality of position stops, each of the position stops being configured to engage the first surface of the cross-pin to selectively secure the gas regulator in one of a plurality of rotationally fixed positions within the gas regulator bore, wherein each of the plurality of position stops of the gas regulator defines a flat and the first surface of the cross-pin defines a flat.

2. The adjustable gas regulator assembly according to claim 1, wherein the gas regulator is biased into engagement with cross-pin and rotational movement of the gas regulator within the gas regulator bore causes the first surface of the cross-pin to cam the gas regulator to effect axial movement of the gas regulator within the gas regulator bore.

3. The adjustable gas regulator assembly according to claim 1, wherein the gas regulator includes an adjustment knob to facilitate manual rotation of the gas regulator within the gas regulator bore.

4. The adjustable gas regulator assembly according to claim 1, wherein the gas regulator defines an annular channel between the plurality of position stops and the adjustment knob, the cross-pin being received within the annular channel to prevent separation of the gas regulator from the gas regulator bore.

5. The adjustable gas regulator assembly according to claim 4, wherein the cross-pin is removable from the cross-pin bore to facilitate separation of the gas regulator from the gas regulator bore.

6. The adjustable gas regulator assembly according to claim 1, wherein a piston is received within a second end of the gas block bore.

7. The adjustable gas regulator assembly according to claim 6, wherein the piston is biased into engagement with the gas regulator to urge the gas regulator into engagement with the cross-pin.

8. The adjustable gas regulator assembly according to claim 7, wherein the piston is configured to engage a rifle operating system.

9. The adjustable gas regulator assembly according to claim 7, wherein the piston is configured to engage an op-rod of a direct gas impingement system of a rifle to urge the piston into engagement with the gas regulator.

10. The adjustable gas regulator assembly according to claim 5, wherein when the cross-pin is received within the annular channel, the gas regulator is capable of 360° rotation without effecting separation of the gas regulator from the gas block bore.

11. The adjustable gas regulator assembly according to claim 3, wherein the adjustment knob is fixed in relation to the gas regulator such that rotation of the adjustment knob effects corresponding rotation of the gas regulator.

12. The adjustment gas regulator assembly according to claim 11, wherein the adjustment knob is configured to allow ambidextrous single handed operation.

13. An adjustable gas regulator assembly for use with a gas operated firearm, the adjustable gas regulator assembly comprising:

a gas block defining a barrel bore configured to receive the barrel of a firearm, a cross-pin bore and a gas regulator bore, the gas regulator bore communicating with the barrel bore via a gas block gas port;

a gas regulator rotatably received within a first end of the gas regulator bore, the gas regulator defining a plurality of regulator gas ports, the gas regulator being rotatable within the first end of the gas regulator bore to selectively position any one of the plurality of regulator gas ports in registration with the gas block gas port;

a cross-pin positioned within the cross-pin bore, the cross-pin defining a first surface, wherein the gas regulator defines a plurality of position stops, each of the position stops being configured to engage the first surface of the cross-pin to selectively secure the gas regulator in one of a plurality of rotationally fixed positions within the gas regulator bore, wherein the first surface of the cross-pin is a 45° flat that is configured to interlock with each of the plurality of position stops.

14. An adjustable gas regulator assembly for use with a gas operated firearm, the adjustable gas regulator assembly comprising:

a gas block defining a barrel bore configured to receive the barrel of a firearm, a cross-pin bore and a gas regulator bore, the gas regulator bore communicating with the barrel bore via a gas block gas port;

a gas regulator rotatably received within a first end of the gas regulator bore, the gas regulator defining a plurality of regulator gas ports, the gas regulator being rotatable within the first end of the gas regulator bore to selectively position any one of the plurality of regulator gas ports in registration with the gas block gas port;

a cross-pin positioned within the cross-pin bore, the cross-pin defining a first surface, wherein the gas regulator defines a plurality of position stops, each of the position stops being configured to engage the first surface of the cross-pin to selectively secure the gas regulator in one of a plurality of rotationally fixed positions within the gas regulator bore, wherein each of the plurality of position stops includes a 45° flat to interlock with the cross-pin.

15. The adjustable gas regulator assembly according to claim 1, wherein the plurality of regulator gas ports are dimensioned to optimize gas flow for sub and supersonic ammunition with or without a silencer.

16. The adjustable gas regulator assembly according to claim 1, wherein a compression spring is positioned to urge the gas regulator into engagement with the cross-pin to urge a selected one of the plurality of position stops into engagement with the cross-pin.

* * * * *